US006192796B1

(12) United States Patent
Hansson

(10) Patent No.: US 6,192,796 B1
(45) Date of Patent: Feb. 27, 2001

(54) SPRAY DAMPENING DEVICE FOR A PRINTING PRESS

(75) Inventor: Birger Hansson, Åkarp (SE)

(73) Assignee: Jimek AB, Arlov (SE)

( * ) Notice: Subject to any disclaimer, the term of this patent is extended or adjusted under 35 U.S.C. 154(b) by 0 days.

(21) Appl. No.: 09/367,302

(22) PCT Filed: Feb. 16, 1998

(86) PCT No.: PCT/SE98/00264

§ 371 Date: Feb. 7, 2000

§ 102(e) Date: Feb. 7, 2000

(87) PCT Pub. No.: WO98/35833

PCT Pub. Date: Aug. 20, 1998

(30) Foreign Application Priority Data

Feb. 17, 1997 (SE) ..... 9700535

(51) Int. Cl.[7] ..... B41L 23/08; B41L 25/06

(52) U.S. Cl. ..... 101/147; 101/148

(58) Field of Search ..... 101/147, 148, 101/366, 365, 351.8; 239/587.6, 587.5, 587.1, 551, 556

(56) References Cited

U.S. PATENT DOCUMENTS

| | | | | |
|---|---|---|---|---|
| 2,543,663 | * | 2/1951 | Marsden | 101/147 |
| 4,044,674 | * | 8/1977 | Smith, Jr. | 101/148 |
| 4,831,927 | * | 5/1989 | Lin | 101/148 |
| 5,040,457 | * | 8/1991 | Lin | 101/147 |
| 5,505,126 | * | 4/1996 | Ohno et al. | 101/147 |
| 5,595,116 | * | 1/1997 | Ohkawara | 101/147 |

* cited by examiner

*Primary Examiner*—John S. Hilten
*Assistant Examiner*—Leslie J. Grohusky
(74) *Attorney, Agent, or Firm*—James Ray & Associates

(57) ABSTRACT

A spray dampening device for spraying fountain solution on a rotating roller (1) in a printing press has a spray casing (2) to be mounted in the vicinity of the roller and a spray beam (3) with a number of spray valves (7). The spray beam is at each end attached to the spray casing, which is fixedly mounted to the printing press frame (6), by means of a mounting bracket (15) allowing longitudinal adjustment of the spray beams and thus the spray valves in relation to the fixed spray casing.

13 Claims, 4 Drawing Sheets

SPRAY DAMPENING DEVICE FOR A PRINTING PRESS

TECHNICAL FIELD

The present invention relates to a spray dampening device for spraying fountain solution on a rotating roller in a printing press, comprising a spray casing to be fixedly mounted to the printing press frame in the vicinity of the roller and a number of spray valves for spraying fountain solution on the roller through the spray casing.

BACKGROUND OF THE INVENTION

A device of the kind defined above is disclosed in U.S. Pat. No. 5,595,116, which is regarded as the closest prior art. The spray casing is divided into two parts, of which a forward one is fixedly mounted to the printing press frame and a rearward one is provided with the spray valves and can be position adjusted in relation to the forward one by a complicated arrangement.

Normally, however, a spray dampening device is an integrated unit, comprising a spray beam with the spray valves and the spray casing, mounted in the printing press frame. With a design of this type an adjustment of the position of the valves in relation to the roller is very awkward, and also the servicing of the valves and the cleaning of the entire device may be very difficult.

A certain improvement in the above respects has been obtained by having the spray casing and the spray beam with its valves as separate units, but still the above drawbacks have in principle not been eliminated.

THE INVENTION

A better solution is according to the invention attained in that a separate spray beam, in which the spray valves are arranged, at each end is attached to the spray casing by means of a mounting bracket, allowing longitudinal adjustment of the spray beam and thus the spray valves in relation to the fixed spray casing. In this way the spray dampening device can also be made totally enclosed but still be easy to mount, dismount and service.

The mounting bracket may preferably be attached to the spray beam, in a first embodiment, or to the spray casing, in a second embodiment, by means of screws or the like extending through at least two oblong bracket holes, which are substantially parallel to a line normal to the roller, so that an easy adjustment of the position of the spray beam in relation to the spray casing may be performed.

By its fixed mounting the spray casing may be arranged so close to the roller that very little fountain solution leaves it inadvertently in the form of undesired mist, whereas the design with the mounting brackets for mounting the spray beam with the valves to the spray casing enables a very simple and accurate position adjustment of the spray beam and thus the valves in relation to the casing and the roller.

A further advantage can be obtained, if according to the invention the mounting bracket is pivotably and releasably attached to the spray casing, in the first embodiment, or to the spray beam, in the second embodiment, by means of two attachment devices at opposite sides of the line normal to the roller. Depending on which attachment devices that are released the spray beam may be pivoted to either side or even be released completely. It will hereby be very easy to mount, clean and service the beam and its valves and nozzles. Also, the beam can be mounted at either side of the roller or with the connection devices to the left or the right without any design changes.

An advantageous design is obtained in that the attachment devices are spring-biassed pins, which extend into corresponding bores in the ends of the spray casing or the the spray beam, respectively. Further, each pin may preferably be locked in a position retracted out of engagement with its bore.

With the design of the spray dampening device according to the invention the spray casing may be of a rather simple construction and can for example be made of a plastic material. The valve nozzles of the spray beam valves may extend into the valve casing through circular openings, which are provided with flexible sealing means. In this way the fountain solution sprayed through the nozzles will not appear as undesired mist in the printing press and is prevented from reaching the spray beam with its different details and electrical installations. The sealing means may also fulfil its sealing task after every adjustment of the spray beam position.

In previously known spray beams the valves were mechanically attached to the beam at predetermined locations. The valves were connected by means of hoses and couplings. A far better solution is according to the invention attained in that rigid pipes are utilized instead of the hoses. The distances between the valves in the spray beam are hereby determined by the length of the liquid pipes, which are simply sealingly inserted into the valves. No separate attachment for the valves is hereby needed, which makes it possible to mount the spray beam at a lower cost and much easier to service the beam, which can be detached from the fixedly mounted spray casing without any difficulty.

By constructing the device according to the invention, the spray beam is symmetric and may be mounted in any position without any modification.

BRIEF DESCRIPTION OF THE DRAWINGS

The invention will be described in further detail below reference being made to the accompanying drawings, in which.

DETAILED DESCRIPTION OF THE INVENTION

Figure 1:
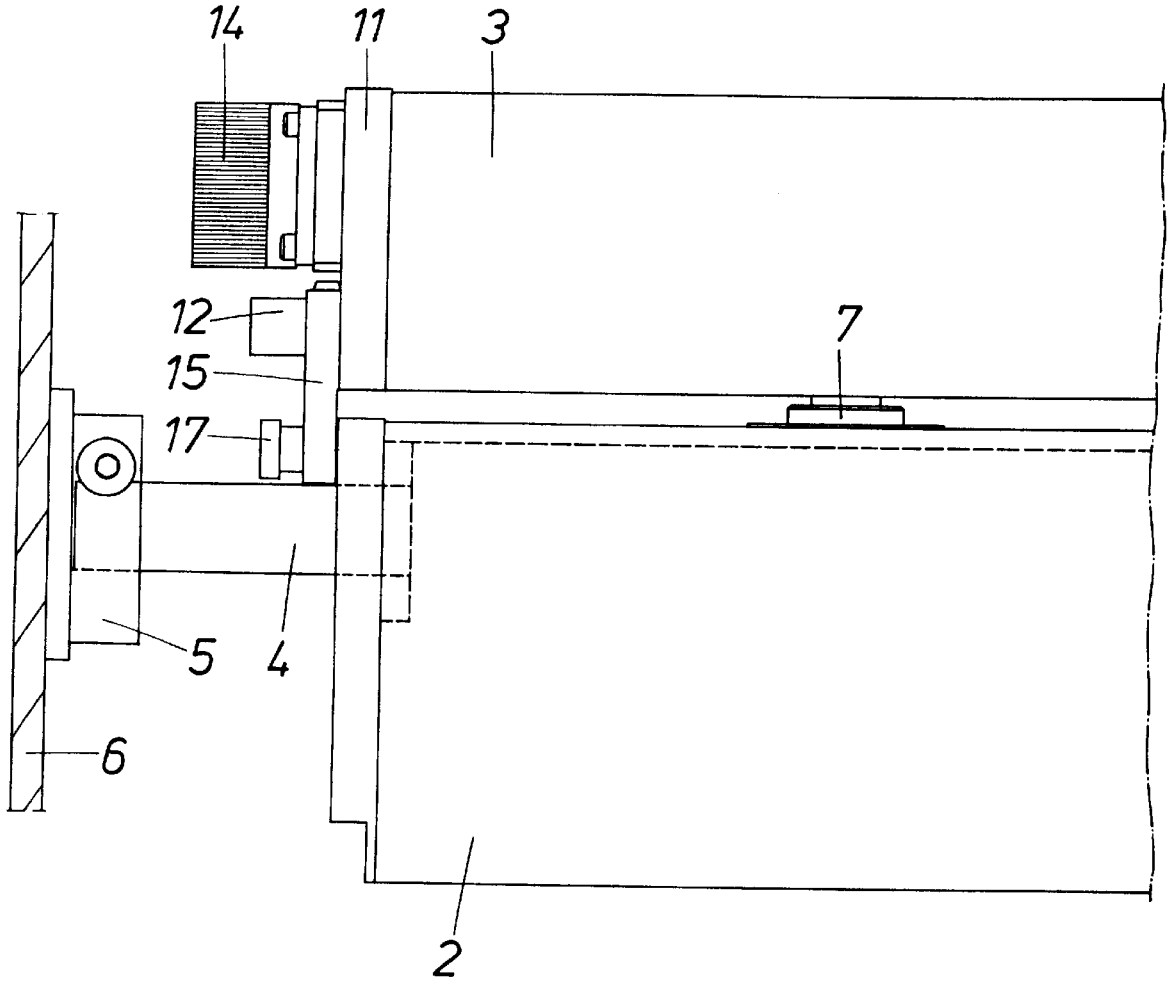
FIG. 1 is a top view of a portion of a first embodiment of a spray dampening device according to the invention.

A first embodiment of a spray dampening device according to the invention will first be described under reference to FIGS. 1–5, whereupon a second and preferred embodiment will be described under reference to FIGS. 6 and 7.

As is well known in the art, a rotating roller 1 (FIG. 3) in a printing press is to be evenly sprayed or damped with fountain solution by means of a spray dampening device.

Such a device according to the invention generally includes a spray casing 2 and a spray beam 3.

The spray casing 2 may be made of a plastic material and normally has a length corresponding to the length of the printing press roller 1 and is generally closed except at its side facing the roller. It is fixedly mounted close to the roller 1, so that a minimum of the liquid sprayed within it leaks out to the environment in the form of undesired mist. The mounting appears in FIG. 1 and consists simply of a rod 4 attached to the spray casing 2 and to an attachment 5 in the printing press frame 6.

In its wall opposite the roller 1, the casing 2 is provided with a number of preferably circular openings for spray valves 7 to be described.

The spray beam 3 is attached to the spray casing 2 in a way to be described. An important feature of the invention is that there is no attachment of the spray beam 3 to the printing press frame 6; to the contrary, the spray beam is fully suspended by the spray casing 2 fixedly mounted to the frame.

Figure 3:
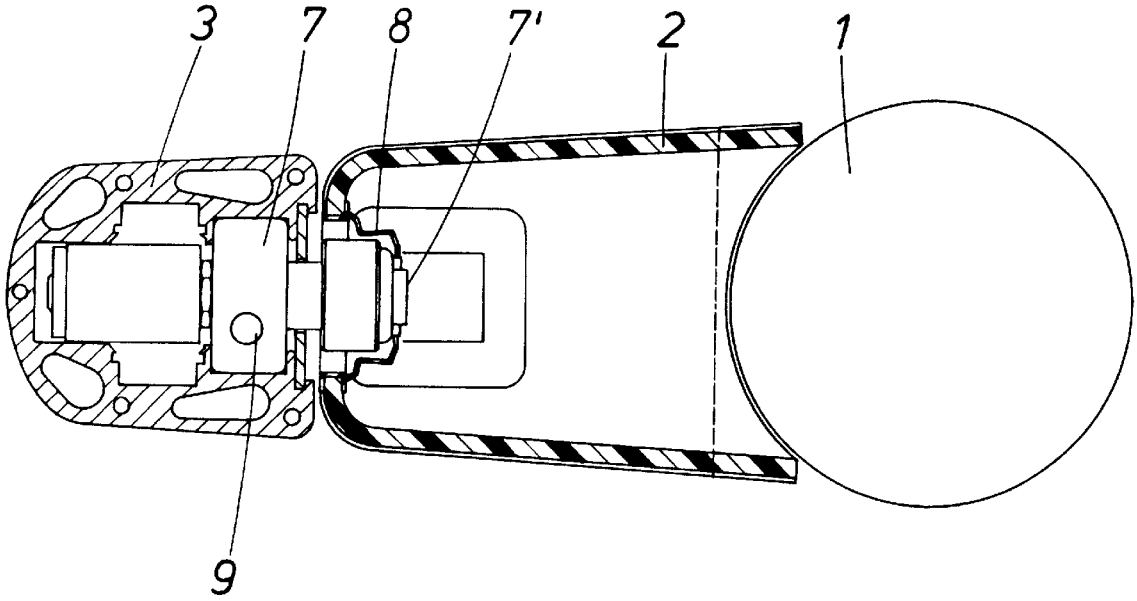
FIG. 3 is a sectional view through the spray dampening device according to FIG. 1 arranged at a roller to be sprayed.

The spray beam 3 is shown in section in FIG. 3. Spray valves 7 are inserted into the spray beam 3 at intervals, preferably equidistantly. The distances between the valves 7 shall correspond to the distances between the mentioned openings in the spray casing 2, or vice versa. The spray nozzles 7' of the valves 7 extend into the spray casing 2, and there is preferably a flexible bellows 8 between each nozzle 7' and the corresponding spray casing opening for sealingly preventing communication from the interior of the spray casing 2.

Figure 4:
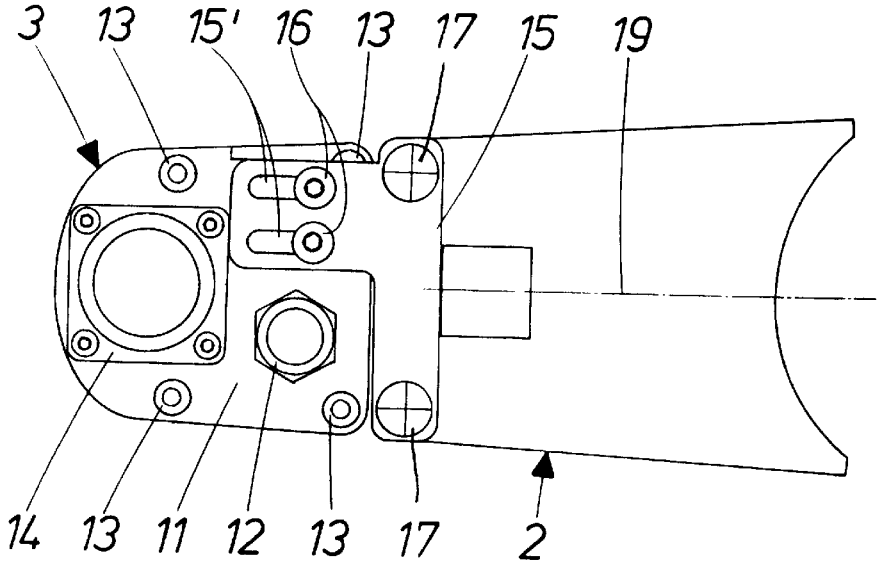
FIG. 4 is an end view of the spray dampening device according to FIG. 1.

There is a through hole 9 in the valve 7 for spray liquid. Longitudinal liquid pipes 10 in the spray beam 3 are inserted into the hole 9, which at each end is provided with a sealing and a shoulder. The length of each rigid liquid pipe 10 determines the distance between each consecutive spray valve 7, which is not otherwise attached in the spray beam 3. At the end of the spray beam 3 there is a gable 11 with an external liquid connector 12 to the internal pipes 10 and valves 7. The gable 11 is attached to spray beam itself by means of screws 13 (FIG. 4).

The spray valves 7 are electrically controlled magnet valves. External electrical connection is provided by an electrical connector 14 on the gable 11, and there is room in the spray beam 3 for electric wires and the like.

The mounting of the spray beam 3 to the spray casing 2 shall now be described.

A mounting bracket 15 (best shown in FIG. 4) is attached to each spray beam gable 11 by means of two screws 16 extending through oblong holes 15' in the bracket 15 and into the gable 11. The holes 15' extend generally parallel to a central line 19, which is normal to the roller 1 and extends through the spray beam 3, the spray casing 2 and the roller 1.

The mounting bracket 15 is also releasably attached to the spray casing 2 by means of two spring-biassed pins 17. Each such pin 17 is axially movably attached to the bracket 15 and is biassed by a spring (not shown) into engagement with a bore 18 (FIG. 5) in the end of the spray casing 2. By turning the pin 17 it may be locked in a position retracted in the bracket 15 out of engagement with the spray casing bore 18.

By the above described design, especially of the mounting brackets 15, it is possible to easily adjust the position of the spray beam 3 and thus of all the valves 7 in relation to the roller 1, which is to be sprayed. This adjustment is only limited by the length of the oblong holes 15' and can easily be made with the desired precision.

Figure 5:
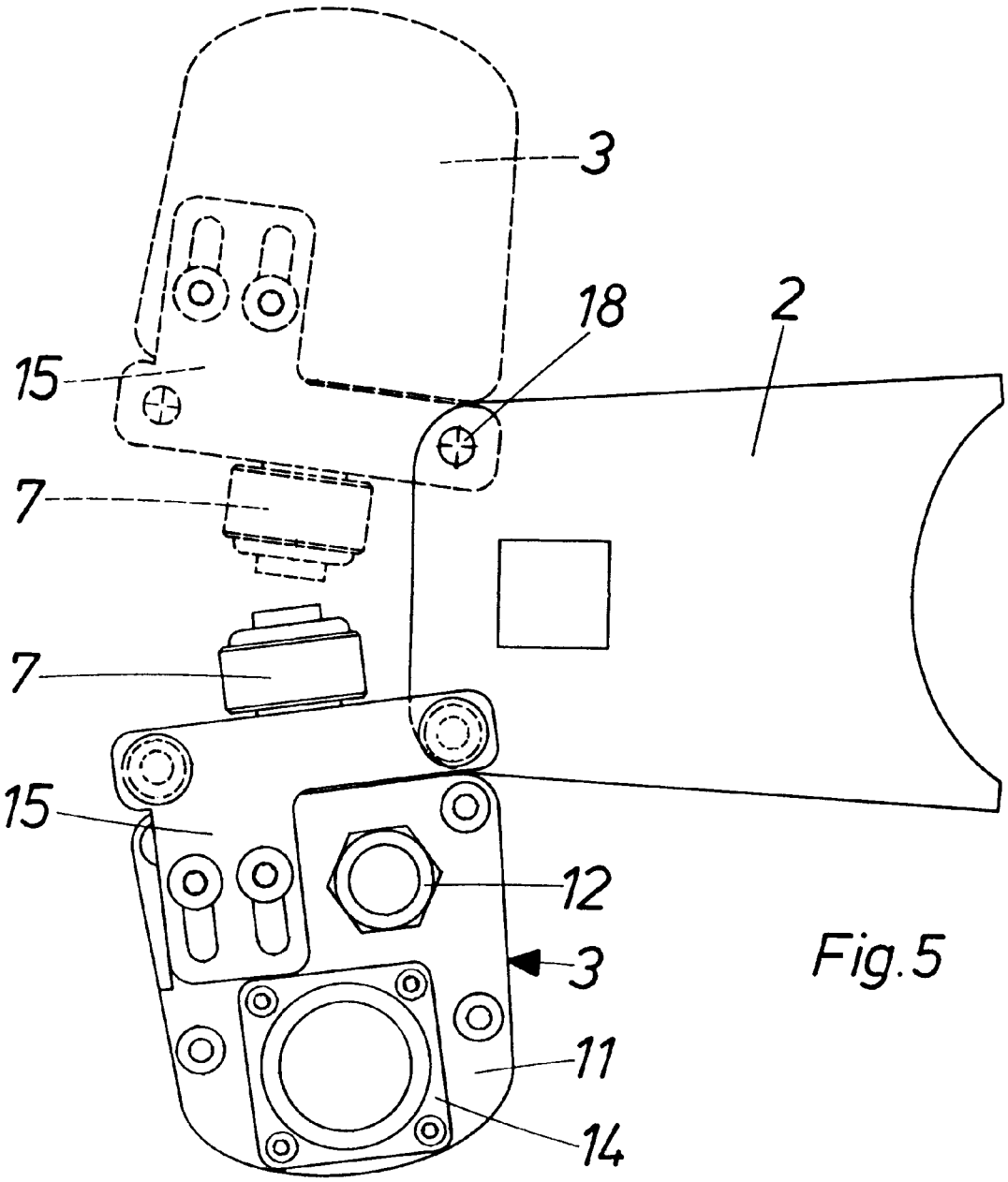
FIG. 5 is a view corresponding to FIG. 4 and illustrates an important aspect of the invention.

A further advantage of the descibed design is that the spray beam 3—as is illustrated in FIG. 5—can be pivoted in two directions for easy access to the valve nozzles 7' for service and the like. The same device may accordingly without modifications be used for mounting at either side of a roller 1—to the left as shown in FIG. 3 or to the right. Also, the spray beam 3 may easily be completely removed.

Figure 6:
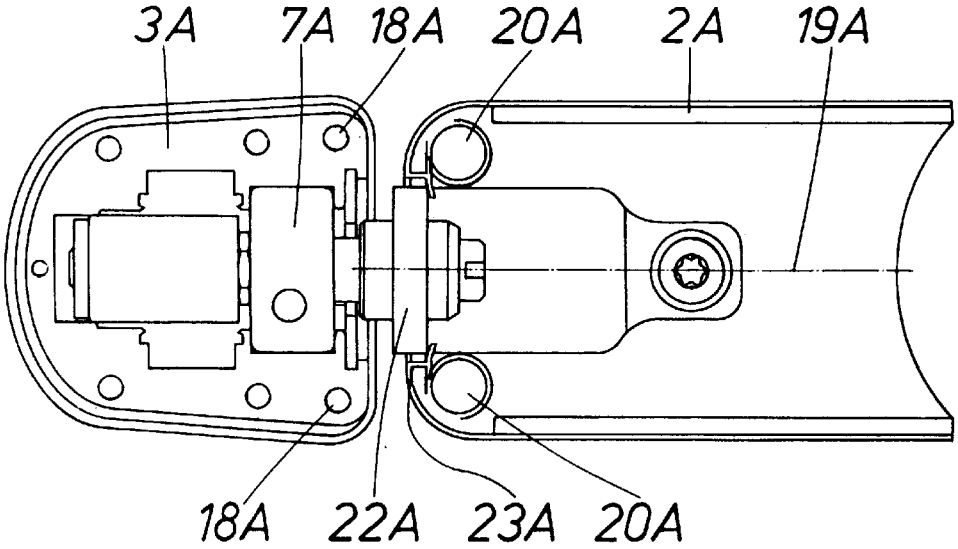
FIG. 6 is a sectional view through a second embodiment of a spray dampening device according to the invention.
Figure 7:
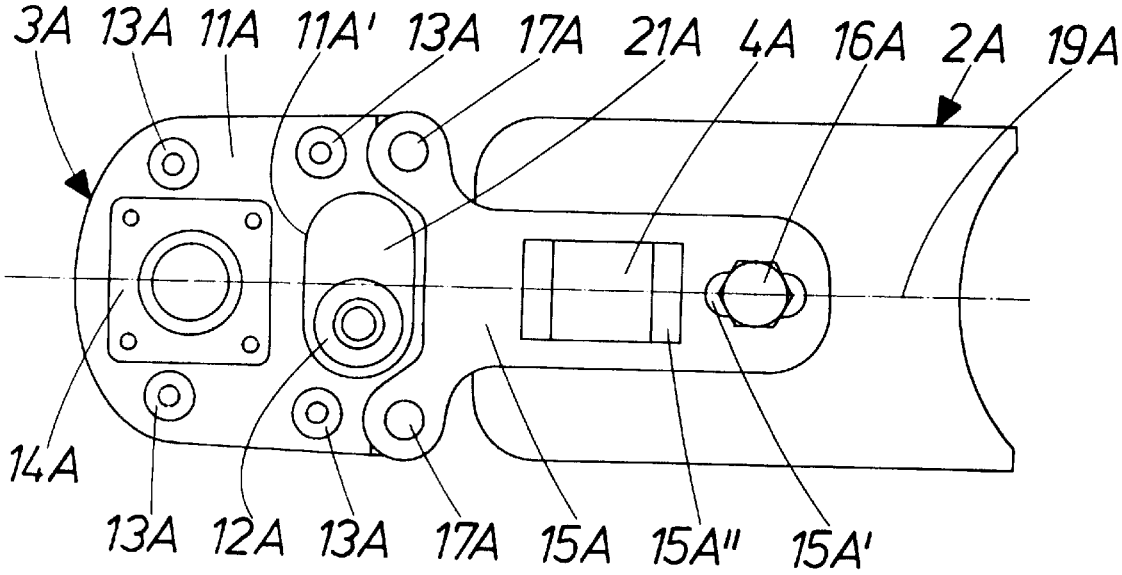
FIG. 7 is an end view of the spray dampening device according to FIG. 6.

A second and preferred embodiment of a spray dampening device according to the invention is shown in FIGS. 6 and 7. The first and second embodiments have very much in common, and accordingly corresponding parts have corresponding reference numerals with the addition of an "A" for the second embodiment.

The following parts may accordingly be found in FIG. 6 and/or FIG. 7: a spray casing 2A, a spray beam 3A, a mounting rod 4A, a spray valve 7A, a gable 11A, an external liquid connector 12A, screws 13A, an electrical connector 14A, a mounting bracket 15A, an oblong hole 15A', a screw 16A, spring-biassed pins 17A, bores 18A, and a central line 19A.

An obvious difference between the two embodiments is that in the second embodiment the mounting bracket 15A at each side of the device is mounted to the spray beam gable 11A by means of the spring-biassed pins 17A, enabling the spray beam 3A to be pivoted in either direction (as illustrated in FIG. 5 for the first embodiment) or to be removed completely.

The mounting bracket 15A is towards its opposite end provided with the oblong hole 15A' for the screw 16A, which is to be fastened in the spray casing 2A, when the correct position of the spray beam 3A and thus the valves 7A therein has been determined. The mounting bracket 15A is also provided with a second oblong hole 15A" for the mounting rod 4A to pass through. In this way the mounting rod 4A can act as a support and guide for the mounting bracket 15A.

One of the advantages with the described arrangement of the mounting bracket 15A in the second embodiment is that it will be possible to arrange appropriate drainage holes 20A (FIG. 6) in the spray casing 2A. Two such holes 20A may be provided in each end of the spray casing 2A, and normally only one of the four holes is left unplugged for collection of waste fountain solution from the spray casing 2A.

Figure 2:
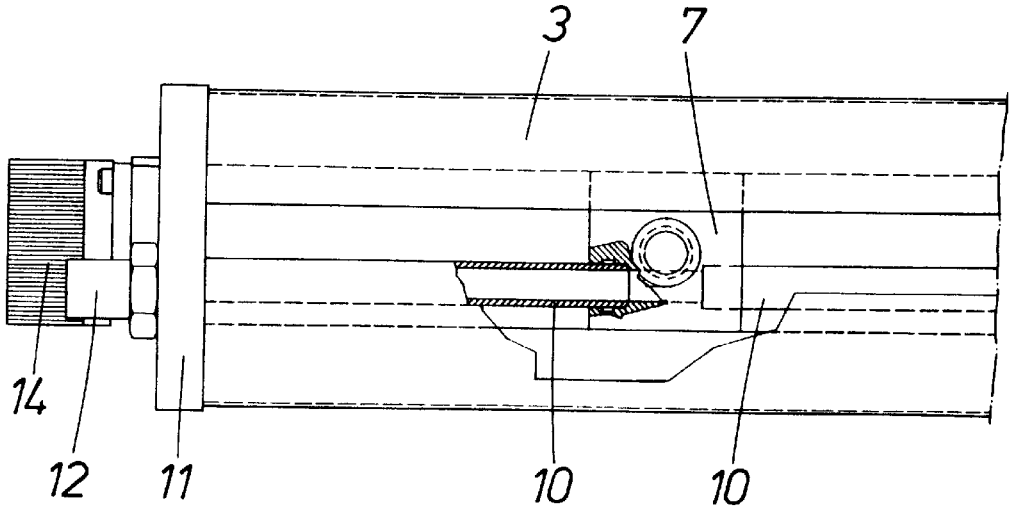
FIG. 2 is a front view, partly in section, of a spray beam forming a part of the spray dampening device according to FIG. 1.

A second modification in relation to the first embodiment is the arrangement at the liquid connector 12A for supplying fountain solution to the valves 7A (in the way depicted in FIGS. 1 and 2 for the first embodiment). The liquid connector 12A passes non-centrally through an oblong inset 21A mounted in an oblong hole 11A' in the spray beam gable 11A. In this way only one version of the gable 11A is needed irrespective of the mounting position of the spray beam 3A.

A further modification in comparison with the first embodiment is in the sealing of each valve 7A in relation to the respective hole in the spray casing 2A. In this case the valve 7A is provided with a sealing ring 22A, which has to be mounted in an appropriate position on the valve 7A in relation to the mounting position of the spray beam 3A on the spray casing 2A. Cooperating with the sealing ring 22A is a flexible sealing sleeve 23A of a rubbery material mounted in the hole of the spray casing 2A.

What is claimed is:

1. A spray dampening device for spraying fountain solution on a rotating roller (1) in a printing press, said spray dampening device comprising a spray casing (2; 2A) to be fixedly mounted to a frame (6) of the printing press in the vicinity of the roller (1), a number of spray valves (7; 7A) for spraying fountain solution on the roller (1) through the spray casing (2; 2A), and a separate spray beam (3; 3A), in which the spray valves (7; 7A) are arranged, pivotably attached to the spray casing (2; 2A) at each end.

2. The spray dampening device according to claim 1 wherein the spray beam (3; 3A) at each end is attached to the spray casing (2; 2A) by means of a mounting bracket (15; 15A) allowing pivotable movement of the spray beam (3; 3A).

3. The spray dampening device according to claim 2 wherein the mounting bracket (15) is attached to the spray beam (3) by means of screws (16) extending through at least two oblong bracket holes (15'), which are substantially parallel to a line (19) normal to the roller (1), for allowing longitudinal adjustment of the spray beam (3) and thus the spray valves (7) in relation the spray casing (2) as mounted.

4. The spray dampening device according to claim 2 wherein the mounting bracket (15A) is attached to the spray casing (2A) by means of a screw (16A) extending through an oblong bracket hole (15A'), which is substantially parallel to a line (19A) normal to the roller (1), for allowing longitudinal adjustment of the spray beam (3A) and thus the spray valves (7A) in relation the spray casing (2A) as mounted.

5. The spray dampening device according to claim 2 wherein the mounting bracket (15) is pivotably and releasably attached to the spray casing (2) by means of two attachment devices (17) at opposite sides of the line (19) normal to the roller (1) for allowing pivotable movement in either direction of the spray beam (3).

6. The spray dampening device according to claim 5 wherein the attachment devices are spring-biased pins (17; 17A), which extend into corresponding bores (18; 18A) in the ends of at least one of the spray casing (2) and the spray beam (3A).

7. The spray dampening device according to claim 6 wherein the pins (17; 17A) may be locked in a position retracted out of engagement with the bores (18; 18A).

8. The spray dampening device according to claim 2 wherein the mounting bracket (15A) is pivotably and releasably attached to the spray beam (3A) by means of two attachment devices (17; 17A) at opposite sides of the line (19A) normal to the roller for allowing pivotable movement in either direction of the spray beam.

9. The spray dampening device according to claim 8 wherein the attachment devices are spring-biased pins (17; 17A), which extend into corresponding bores (18; 18A) in the ends of at least one of the spray casing (2) and the spray beam (3A).

10. The spray dampening device according to claim 9 wherein the pins (17; 17A) may be locked in a position retracted out of engagement with the bores (18; 18A).

11. The spray dampening device according to claim 1 wherein each of the spray valves (7; 7A) has a nozzle (7'; 7A') that extends into the spray casing (2; 2A) through an opening, which is provided with flexible sealing means (8; 23A), each having a hole for the nozzle (7'; 7A') corresponding thereto and allowing relative movements between the nozzles (7'; 7A') and the spray casing (2; 2A) with maintained tightness.

12. The spray dampening device according to claim 1 wherein distances between the spray valves (7; 7A) in the spray beam (3; 3A) are determined by lengths of liquid pipes (10) inserted into the spray valves (7; 7A).

13. The spray dampening device according to claim 12 wherein an external liquid connector (12A) to the liquid pipes (10) passes through an oblong inset (21A) mounted in an oblong hole (11A') in a gable (11A) of the spray beam (3).

* * * * *